US011577519B2

(12) United States Patent
Aoyama et al.

(10) Patent No.: US 11,577,519 B2
(45) Date of Patent: Feb. 14, 2023

(54) LIQUID DISCHARGE DEVICE, IMAGE FORMING APPARATUS INCORPORATING THE LIQUID DISCHARGE DEVICE, AND METHOD OF SUPPLYING LIQUID

(71) Applicant: Ricoh Company, Ltd., Tokyo (JP)

(72) Inventors: Jumpei Aoyama, Kanagawa (JP); Hiroaki Maeda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 59 days.

(21) Appl. No.: 17/324,306

(22) Filed: May 19, 2021

(65) Prior Publication Data

US 2021/0370678 A1 Dec. 2, 2021

(30) Foreign Application Priority Data

May 26, 2020 (JP) ..... JP2020-091249

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/1721; B41J 2/17566; B41J 2002/1742
USPC ..... 347/85
See application file for complete search history.

(56) References Cited

U.S. PATENT DOCUMENTS

2003/0038865 A1* 2/2003 Inamura ..... B41J 2/17509 347/85
2005/0212874 A1* 9/2005 Nomura ..... B41J 2/17503 347/84

FOREIGN PATENT DOCUMENTS

JP 2003-159809 6/2003

* cited by examiner

*Primary Examiner* — Matthew Luu
*Assistant Examiner* — Alexander D Shenderov
(74) *Attorney, Agent, or Firm* — Xsensus LLP

(57) ABSTRACT

A liquid discharge device includes a first liquid container, a liquid discharger, a second liquid container, a first liquid flow passage, and a second liquid flow passage. The first liquid container is configured to contain liquid. The liquid discharger is configured to discharge the liquid supplied from the first liquid container in a liquid supply direction. The second liquid container is configured to contain the liquid supplied from the first liquid container. The first liquid flow passage is a passage through which the liquid is supplied from the first liquid container to the liquid discharger via the second liquid container. The second liquid flow passage is a passage through which the liquid is supplied from the first liquid container to the liquid discharger without passing through the second liquid container.

12 Claims, 11 Drawing Sheets

LIQUID DISCHARGE DEVICE, IMAGE FORMING APPARATUS INCORPORATING THE LIQUID DISCHARGE DEVICE, AND METHOD OF SUPPLYING LIQUID

CROSS-REFERENCE TO RELATED APPLICATION

This patent application is based on and claims priority pursuant to 35 U.S.C. § 119(a) to Japanese Patent Application No. 2020-091249, filed on May 26, 2020, in the Japan Patent Office, the entire disclosure of which is hereby incorporated by reference herein.

BACKGROUND

Technical Field

Embodiments of the present disclosure relate to a liquid discharge device, an image forming apparatus incorporating the liquid discharge device, and a method of supplying liquid.

Background Art

Various types of image forming apparatuses such as copiers and printers are known to include an inkjet image forming apparatus that discharges ink onto a sheet to form an image on the sheet.

This type of image forming apparatus, that is, an inkjet image forming apparatus, includes a liquid discharge device that discharges liquidized ink onto a sheet. Generally, the liquid discharge device includes a liquid discharge head that discharges ink, a main tank that contains ink, a sub tank that contains ink, an ink supply tube that connects the liquid discharge head with each of the main tank and the sub tank.

A liquid discharge device supplies ink from the main tank to the liquid discharge head via the sub tank, the ink supply tube, or both.

SUMMARY

Embodiments of the present disclosure described herein provide a novel liquid discharge device including a first liquid container, a liquid discharger, a second liquid container, a first liquid flow passage, and a second liquid flow passage. The first liquid container is configured to contain liquid. The liquid discharger is configured to discharge the liquid supplied from the first liquid container in a liquid supply direction. The second liquid container is configured to contain the liquid supplied from the first liquid container. The first liquid flow passage is a passage through which the liquid is supplied from the first liquid container to the liquid discharger via the second liquid container. The second liquid flow passage is a passage through which the liquid is supplied from the first liquid container to the liquid discharger without passing through the second liquid container.

Further, embodiments of the present disclosure described herein provide an image forming apparatus including a sheet feeding device configured to feed a sheet, and the above-described liquid discharge device that is configured to discharge liquid onto the sheet supplied from the sheet feeding device.

Further, embodiments of the present disclosure described herein provide a method of supplying liquid to a liquid discharger configured to discharge the liquid. The method is configured to selectively execute a first liquid supply process to supply liquid from a first liquid container configured to contain the liquid, to the liquid discharger via a second liquid container configured to contain the liquid supplied from the first liquid container, and a second liquid supply process to supply the liquid from the first liquid container to the liquid discharger without passing through the second liquid container.

BRIEF DESCRIPTION OF THE SEVERAL VIEWS OF THE DRAWINGS

Exemplary embodiments of this disclosure will be described in detail based on the following figures, wherein.

Figure 1:
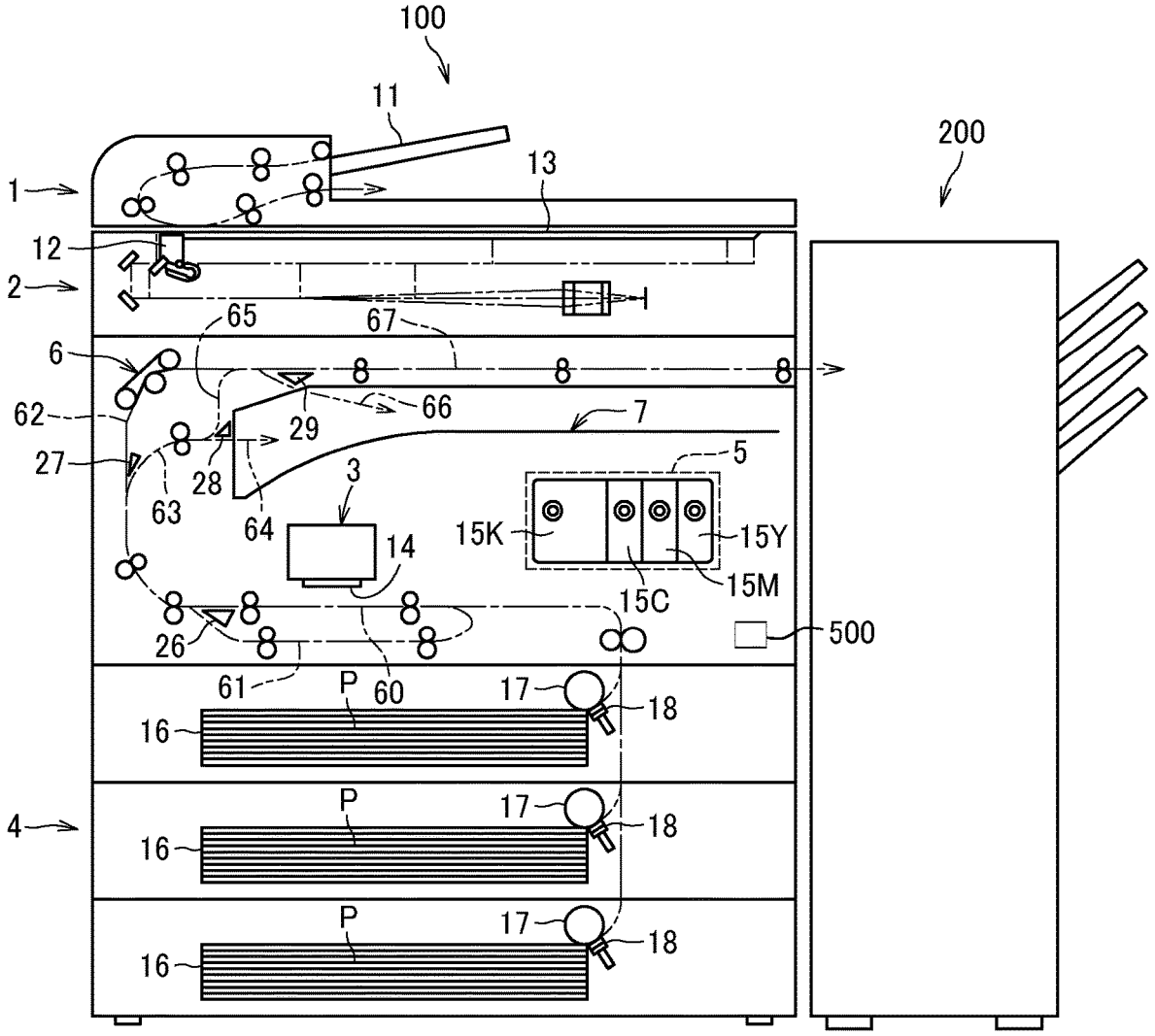
FIG. 1 is a schematic view illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to an image forming apparatus. It is to be noted that elements (for example, mechanical parts and components) having the same functions and shapes are denoted by the same reference numerals throughout the specification and redundant descriptions are omitted.

FIG. 1 is a schematic view illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device 6, and a sheet ejection portion 7. Further, a post-processing apparatus 200 is disposed adjacent to the image forming apparatus 100. The post-processing apparatus 200 may be included in the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of sheet conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid discharger to discharge and apply liquid to a sheet. The liquid discharge head 14 discharges ink to apply the ink to the sheet. The ink is liquid used for image formation.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The drying device 6 is a heating device that heats a sheet to dry ink on the sheet. The drying device 6 according to the present embodiment includes a belt heated by a heat source such as a halogen heater, and a roller that contacts the belt. As a sheet enters between the roller and the belt while the roller and the belt are rotating, the drying device 6 heats the sheet, so that the ink on the sheet is dried by heat applied from the drying device 6 while the sheet is nipped between the belt and the roller. Alternatively, the drying device 6 may be a hot air generator that blows hot air onto the sheet to heat and dry the ink on the sheet.

The sheet feeding device 4 includes a plurality of sheet feed trays 16 each functioning as a sheet container. The sheet feeding device 4 feeds a sheet from a selected one of the plurality of sheet feed trays 16. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The post-processing apparatus 200 performs a post-processing operation (e.g., a sheet alignment operation) on the sheets that are supplied from the image forming apparatus 100. The post-processing apparatus 200 may include a post-processing device such as a sheet aligner that aligns a plurality of sheets and ejects the plurality of sheets to a sheet ejection tray. The post-processing device of the post-processing apparatus 200 may further include a hole puncher that punches the sheet to make a hold in the sheet or the plurality of sheets, a sheet binder that binds the plurality of sheets, for example, in two or in three.

To provide a fuller understanding of the embodiments of the present disclosure, a description is now given of the basic image forming operation of the image forming apparatus 100 according to the present embodiment, with continued reference to FIG. 1.

As an instruction is given to start the printing operation, the sheet P is fed from one sheet feed tray 16 of the plurality of sheet feed trays 16 of the sheet feeding device 4. To be more specific, as the sheet feed roller 17 rotates, the uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 60 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image.

Note that the image to be formed on the sheet P may be a meaningful image such as text or a figure, or a pattern having no meaning per se.

When duplex printing is performed, the sheet P is conveyed in the opposite direction opposite the sheet conveyance direction at a position downstream from the image forming device 3 in the sheet conveyance direction, so that the sheet P is guided to a sheet reverse passage 61. To be more specific, after the trailing end of the sheet P has passed a first passage changer 26 that is disposed downstream from the image forming device 3 in the sheet conveyance direction, the first passage changer 26 changes the sheet conveyance passage to the sheet reverse passage 61, and therefore the sheet P is conveyed in the opposite direction. Accordingly, the sheet P is guided to the sheet reverse passage 61. Then, as the sheet P passes through the sheet reverse passage 61, the sheet P is reversed upside down and conveyed to the image forming device 3 again. Then, the image forming device 3 repeats the same operation performed to the front face of the sheet P, so as to form an image on the back face of the sheet P.

A second passage changer 27 is disposed downstream from the first passage changer 26 in the sheet conveyance direction. The second passage changer 27 guides the sheet P with the image, selectively to a sheet conveyance passage 62 that runs through the drying device 6 or to a sheet conveyance passage 63 that does not run through the drying device 6. When the sheet P is guided to the sheet conveyance passage 62 through which the sheet P passes the drying device 6, the drying device 6 dries the ink on the sheet P. On the other hand, when the sheet P is guided to the sheet conveyance passage 63 through which the sheet P does not pass the drying device 6, a third passage changer 28 guides the sheet P selectively to a sheet conveyance passage 64 toward the sheet ejection portion 7 or to a sheet conveyance passage 65 toward the post-processing apparatus 200. Further, after the sheet P has passed the drying device 6, a fourth passage changer 29 guides the sheet P, selectively to a sheet conveyance passage 66 toward the sheet ejection portion 7 or to a sheet conveyance passage 67 toward the post-processing apparatus 200.

When the sheet P is guided to the sheet conveyance passage 64 toward the sheet ejection portion 7 or to the sheet conveyance passage 66 toward the sheet ejection portion 7, the sheet P is ejected to the sheet ejection portion 7. On the other hand, in a case in which the sheet P is guided to the sheet conveyance passage 65 toward the post-processing apparatus 200 or to the sheet conveyance passage 67 toward the post-processing apparatus 200, the sheet P is conveyed to the post-processing apparatus 200, so that the post-processing operation is performed to the sheet P. Note that, in a case in which an image is formed on only one face (e.g., the image forming surface on which ink is applied) of the sheet P, the sheet P is conveyed to the sheet ejection portion 7 or to the post-processing apparatus 200 with the image forming surface of the sheet P facing down. This type of sheet ejection is referred to as a face-down type sheet ejection. Alternatively, the sheet P may be conveyed to the sheet ejection portion 7 or to the post-processing apparatus 200 with the image forming surface of the sheet P facing up. This type of sheet ejection is referred to as a face-up type sheet ejection.

As described above, a series of printing operations are completed.

Next, a description is given of the configuration of the liquid discharge head 14 according to the present embodiment.

Figure 2:
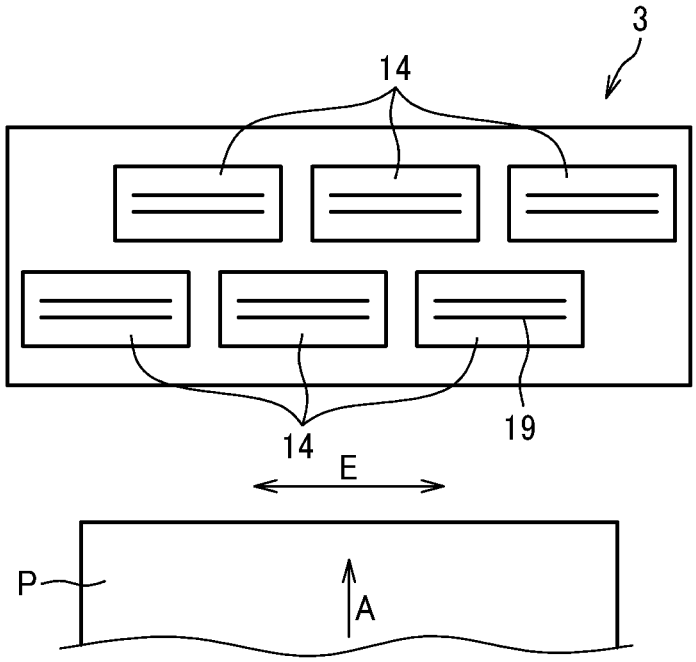
FIG. 2 is a plan view illustrating a line-type liquid discharge head.

FIG. 2 is a plan view illustrating a line-type liquid discharge head, that is, the liquid discharge head 14 according to the present embodiment.

As illustrated in FIG. 2, the image forming device 3 includes a plurality of liquid discharge heads 14 aligned in the sheet conveyance direction A (direction intersecting with the main scanning direction E) and the sheet width direction (main scanning direction E) of the base of the image forming device 3. Each of the liquid discharge heads 14 is a line-type liquid discharge head and is provided with a nozzle row 19 with the arrangement of a plurality of nozzles.

With respect to the liquid discharge heads 14, as the sheet P is conveyed to the image forming device 3, when the sheet P passes through the opposing region facing the image forming device 3, the driving of ink discharge from each of the liquid discharge heads 14 is controlled by the drive signal based on the image information. Therefore, ink of each color is discharged from each of the liquid discharge heads 14 onto the sheet P. Accordingly, an image according to the image information is formed on the sheet P.

Next, a description is given of the configuration of a liquid discharge device that discharges liquid from each of the liquid discharge heads 14.

Figure 3:
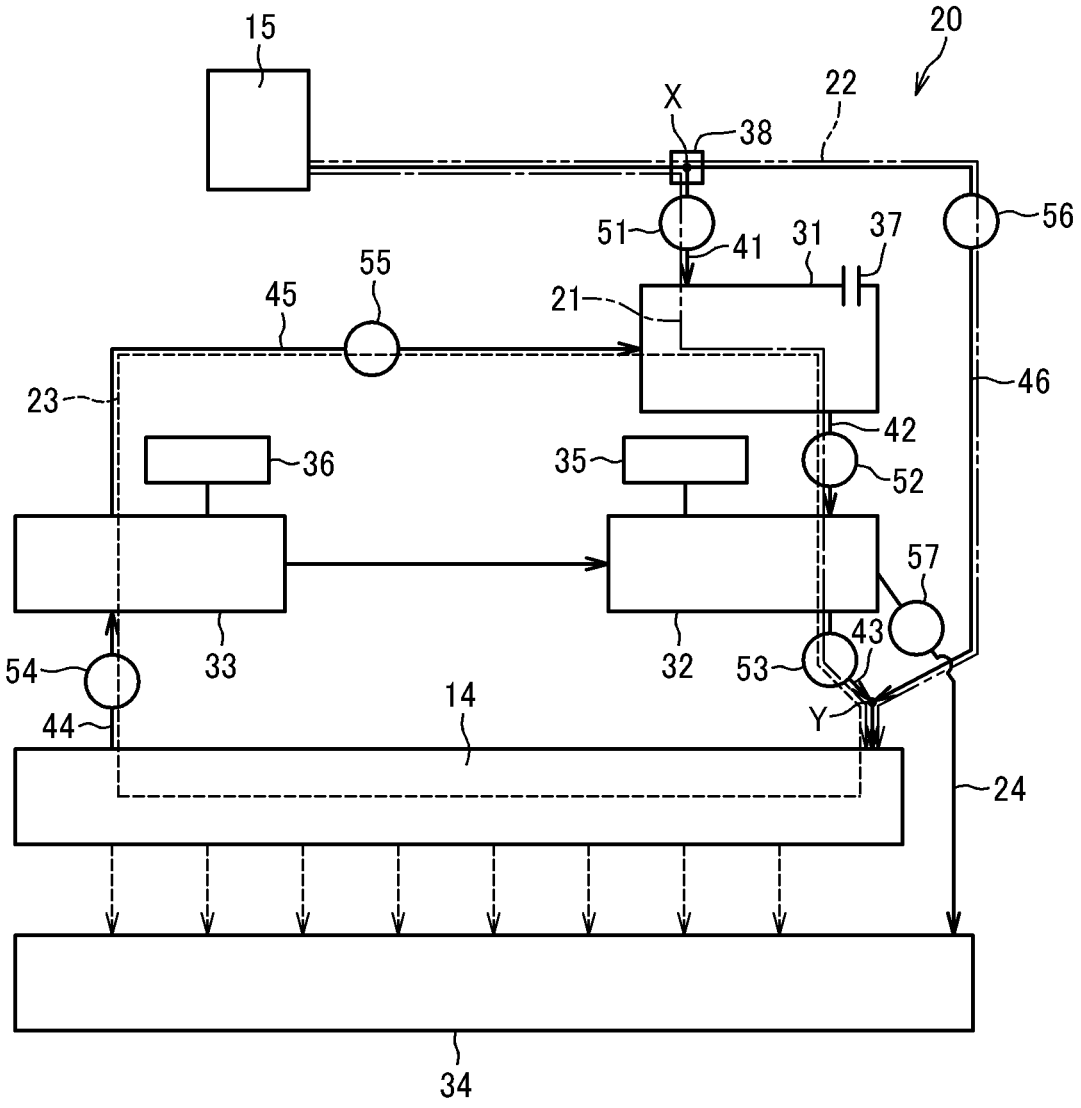
FIG. 3 is a schematic view illustrating a liquid discharge device according to the present embodiment.

FIG. 3 is a schematic view illustrating a liquid discharge device according to the present embodiment.

As illustrated in FIG. 3, the image forming apparatus 100 according to an embodiment of the present disclosure includes a liquid discharge device 20. The liquid discharge device 20 according to the present embodiment includes the above-described liquid discharge head 14 described above, an ink cartridge 15, a buffer tank 31, an ink supply pressure adjustment tank 32, an ink collection pressure adjustment tank 33, and a waste liquid tank 34. The ink cartridge 15 functions as a main tank. The buffer tank 31 functions as a sub tank. Each of the ink supply pressure adjustment tank 32 and the ink collection pressure adjustment tank 33 functions as a pressure adjuster. The waste liquid tank 34 functions as a liquid collector. The liquid discharge device 20 further includes a controller 500 that controls a liquid supplying operation performed in the liquid discharge device 20. The controller 500 is connected to various drivers driving various parts and units, for example, the above-described parts and units included in the liquid discharge device 20.

The ink cartridge 15 indicates any one of the above-described plurality of ink cartridges 15Y, 15M, 15C, and 15K (see FIG. 1). Here, a description is given of the configuration of the liquid discharge device 20 with one of the plurality of ink cartridges 15Y, 15M, 15C, and 15K, as the ink cartridge 15, as an example. The ink cartridge 15 is connected to the buffer tank 31 through a liquid flow passage 41 illustrated in FIG. 3, in a state in which the ink cartridge 15 is attached to the cartridge container 5 (see FIG. 1). A first liquid supply pump 51 is provided to the liquid flow passage 41 that connects the buffer tank 31 and the ink cartridge 15. The first liquid supply pump 51 functions as a liquid supplier to supply liquid from the ink cartridge 15 to the buffer tank 31.

The waste liquid tank 34 is connected to the ink supply pressure adjustment tank 32 through a waste liquid flow passage 24. A liquid discharge pump 57 is provided to the waste liquid flow passage 24. The liquid discharge pump 57 functions as a waste liquid discharger to drain waste liquid from the ink supply pressure adjustment tank 32 to the waste liquid tank 34. Further, the waste liquid tank 34 collects excess liquid discharged from the liquid discharge head 14.

The buffer tank 31, the ink supply pressure adjustment tank 32, the ink collection pressure adjustment tank 33, and the liquid discharge head 14 are connected to each other through a liquid circulation passage 23 that circulates liquid. The liquid discharge device 20 includes liquid flow passages 42, 43, 44, and 45. Each of the liquid flow passages 42, 43, 44, and 45 is provided with a second liquid supply pump 52, a third liquid supply pump 53, a fourth liquid supply pump 54, and a fifth liquid supply pump 55, each functioning as a liquid supplier. The liquid flow passage 42 extends between the buffer tank 31 and the ink supply pressure adjustment tank 32 to connect the buffer tank 31 and the ink supply pressure adjustment tank 32. The liquid flow passage 43 extends between the ink supply pressure adjustment tank 32 and the liquid discharge head 14 to connect the ink supply pressure adjustment tank 32 and the liquid discharge head 14. The liquid flow passage 44 extends between the liquid discharge head 14 and the ink collection pressure adjustment tank 33 to connect the liquid discharge head 14 and the ink collection pressure adjustment tank 33. The liquid flow passage 45 extends between the ink collection pressure adjustment tank 33 and the buffer tank 31 to connect the ink collection pressure adjustment tank 33 and the buffer tank 31. The second liquid supply pump 52, the third liquid supply pump 53, the fourth liquid supply pump 54, and the fifth liquid supply pump 55 circulate liquid from the buffer tank 31, the ink supply pressure adjustment tank 32, the liquid discharge head 14, and the ink collection pressure adjustment tank 33 in this order, and bring the liquid back to the buffer tank 31. That is, the ink supply pressure adjustment tank 32, the liquid discharge head 14, and the ink collection pressure adjustment tank 33 are disposed downstream from the buffer tank 31 in the liquid supply direction.

Each of the ink supply pressure adjustment tank 32 and the ink collection pressure adjustment tank 33 is a liquid container (liquid tank) to adjust the pressure difference to circulate liquid in the liquid circulation passage 23. To be more specific, the second liquid supply pump 52, the third liquid supply pump 53, the fourth liquid supply pump 54, and the fifth liquid supply pump 55 are provided in the liquid circulation passage 23 to supply liquid in the liquid circulation passage 23. As the second liquid supply pump 52, the third liquid supply pump 53, the fourth liquid supply pump 54, and the fifth liquid supply pump 55 supply liquid in the liquid circulation passage 23, the liquid close to the ink supply pressure adjustment tank 32 to the liquid discharge head 14 is a positive pressure side and the liquid close to the ink collection pressure adjustment tank 33 to the liquid discharge head 14 is a negative pressure side. As a result, the pressure difference is generated between the ink supply pressure adjustment tank 32 and the ink collection pressure adjustment tank 33. According to this pressure difference, liquid circulates the ink supply pressure adjustment tank 32, the liquid discharge head 14, the ink collection pressure adjustment tank 33, and the buffer tank 31, in this order. A pressure adjustment mechanism 35 that functions as a regulator is provided with the ink supply pressure adjustment tank 32 to adjust the pressure in the ink supply pressure adjustment tank 32. Similarly, a pressure adjustment mechanism 36 that functions as a regulator is provided with the ink collection pressure adjustment tank 33 to adjust the pressure in the ink collection pressure adjustment tank 33.

In a case in which the ink cartridge 15 is located below the liquid discharge head 14 in the direction of gravity, a pressure difference that circulates liquid in the liquid circulation passage 23 is obtained due to the difference in hydraulic head between the ink cartridge 15 and the liquid discharge head 14. Therefore, the ink collection pressure adjustment tank 33 may be omitted. On the other hand, in the present embodiment, the ink cartridge 15 is located above the liquid discharge head 14 in the direction of gravity. Therefore, the ink collection pressure adjustment tank 33 is provided to sufficiently obtain pressure difference in the liquid circulation passage 23. Further, the configuration in which the ink collection pressure adjustment tank 33 is provided in the liquid circulation passage 23 is valid when a large amount of liquid is supplied in the liquid circulation passage 23. Therefore, when an inkjet image forming apparatus has a plurality of nozzles and a full-line type liquid discharge head that is capable of discharging ink at once over the width direction of the sheet, the inkjet image forming apparatus is preferably provided with the ink collection pressure adjustment tank 33 in particular.

Further, an atmospheric opening 37 is disposed above the buffer tank 31. The liquid surface (liquid level) of the buffer tank 31 is lower than the nozzle surface of the liquid discharge head 14 by the predetermined distance in the direction of gravity. Therefore, when the atmospheric opening 37 of the buffer tank 31 opens, the liquid discharge head 14 generally has the difference in hydraulic head according to the difference in height. Therefore, when the liquid circulation is stopped, the meniscus of the nozzle of the liquid discharge head 14 is stably maintained due to the difference in hydraulic head generated in the liquid discharge head 14.

Liquid (ink) contained in the ink cartridge may contain air bubbles. Therefore, when the liquid is supplied from the ink cartridge to the liquid discharge head, air bubbles may flow into the liquid discharge head together with the liquid. When bubbles enter the liquid discharge head, the discharge energy (droplet discharge pressure) applied in the liquid chamber of the liquid discharge head is absorbed by the bubbles. Therefore, it is less likely to obtain the optimum droplet discharge pressure, which may result in a droplet discharge failure. In order to address this inconvenience, air bubbles are removed from liquid when supplying liquid.

However, when supplying liquid to the liquid discharge head, in a case in which the liquid is supplied to the liquid discharge head 14 through the liquid circulation passage 23 that connects the buffer tank 31, the ink supply pressure adjustment tank 32, and the ink collection pressure adjustment tank 33, it takes a relatively long time from a timing of completion of liquid supply to the liquid discharge head 14 to a timing of starting the printing operation. In particular, when liquid is supplied to fill the liquid discharge head 14 for the first time, the liquid is not filled in the liquid circulation passage 23 at the initial stage of liquid supply, in other words, at an initial liquid filling, and therefore it takes a relatively long time to complete supplying (filling) the liquid to the liquid discharge head 14. Further, in a case in which the liquid discharge head 14 has a plurality of nozzles as in the present embodiment, liquid is supplied to the liquid discharge head 14 while discharging air bubble from each of the plurality of nozzles. Therefore, the time to complete supplying the liquid to the liquid discharge head 14 further increases. Further, in a case in which the liquid circulation passage 23 is provided with the ink collection pressure adjustment tank 33, the time to adjust the negative pressure is added. Therefore, the time to complete supplying the liquid to the liquid discharge head 14 tends to further increase.

In order to address the above-described inconvenience in which the time to supply liquid to the liquid discharge head 14 becomes longer, the liquid discharge device according to the present embodiment is provided with a liquid flow passage (second liquid flow passage 22) to supply liquid from the ink cartridge 15 to the liquid discharge head 14 without passing through the liquid circulation passage 23, as illustrated in FIG. 3. That is, a liquid discharge device 20 according to the present embodiment includes a first liquid flow passage 21 and a second liquid flow passage 22. The first liquid flow passage 21 is a liquid flow passage to supply liquid from the ink cartridge 15 to the liquid discharge head 14 via the buffer tank 31 and the ink supply pressure adjustment tank 32. The second liquid flow passage 22 is a liquid flow passage to supply liquid from the ink cartridge 15 to the liquid discharge head 14 without passing through the buffer tank 31 and the ink supply pressure adjustment tank 32.

As illustrated in FIG. 3, the second liquid flow passage 22 branches off from the first liquid flow passage 21 at a branching point X that is located upstream from the first liquid supply pump 51 on the first liquid flow passage 21 in the liquid supply direction and meets and merges the first liquid flow passage 21 at a meeting point Y that is located downstream from the third liquid supply pump 53 on the first liquid flow passage 21 in the liquid supply direction. The second liquid flow passage 22 shares parts of the liquid flow passage with the first liquid flow passage 21, other than the part from the branching point X to the meeting point Y of the second liquid flow passage 22. To be more specific, the first liquid flow passage 21 and the second liquid flow passage 22 meet each other at the meeting point Y that is located upstream from the liquid discharge head 14 in the liquid supply direction to communicate with the liquid discharge head 14. Further, the liquid discharge device 20 further includes a sixth liquid supply pump 56 on a liquid flow passage 46 from the branching point X to the meeting point Y of the second liquid flow passage 22. The sixth liquid supply pump 56 functions as a liquid supplier to supply liquid from the ink cartridge 15 to the liquid discharge head 14.

Further, a passage switcher 38 is provided at the branching point X. The passage switcher 38 such as a valve switches the liquid flow passage between the first liquid flow passage 21 and the second liquid flow passage 22. According to this configuration, the liquid discharge device 20 according to the present embodiment selectively executes a first liquid supply process and a second liquid supply process. The first liquid supply process is to supply liquid from the ink cartridge 15 to the liquid discharge head 14 through the first liquid flow passage 21. The second liquid supply process is to supply liquid from the ink cartridge 15 to the liquid discharge head 14 through the second liquid flow passage 22.

Figure 4:
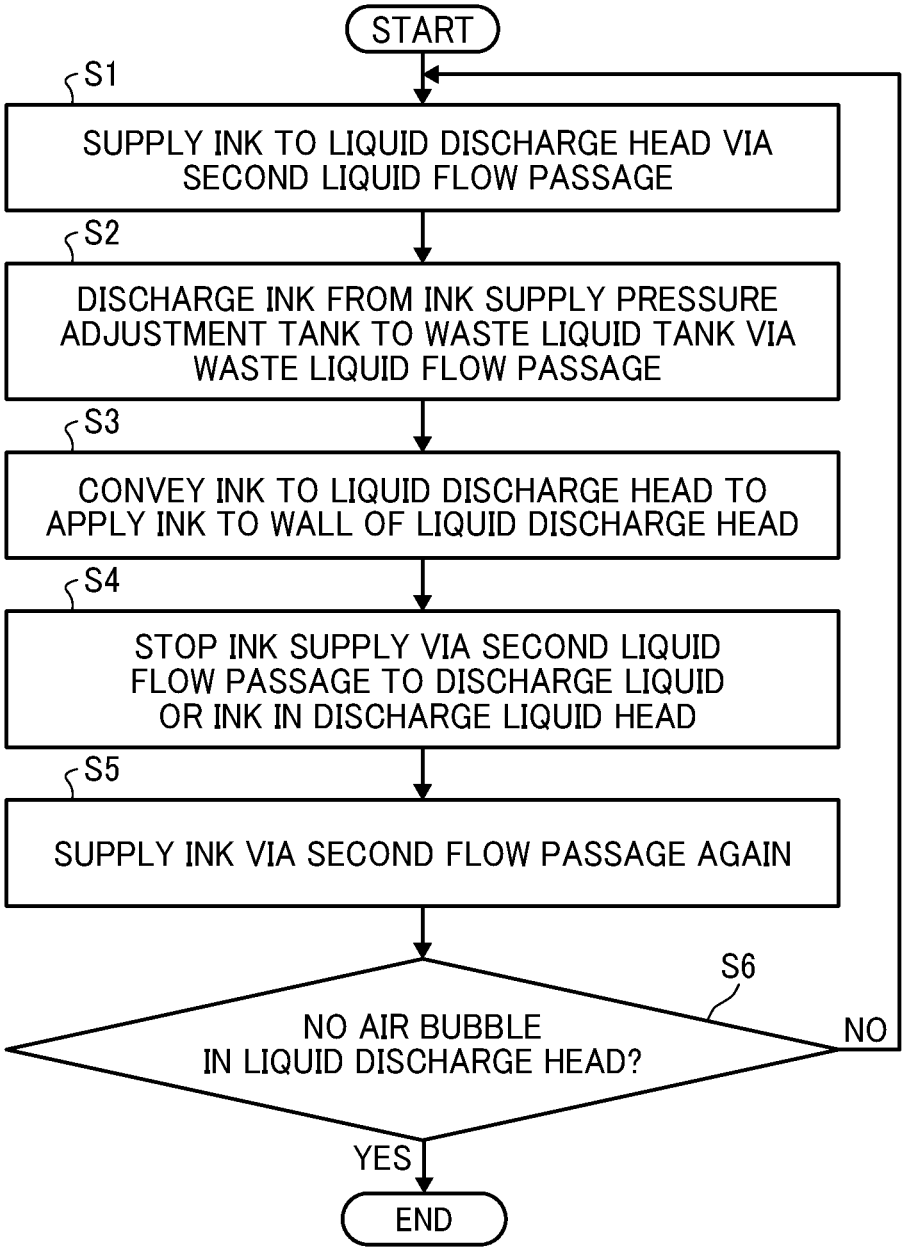
FIG. 4 is a flowchart of an example of a method of supplying liquid by the liquid discharge device according to the present embodiment.

Now, a description is given of a method of initial liquid filling (method of supplying liquid) when filling ink in the liquid discharge head 14 for the first time, with reference to FIGS. 3 and 4.

FIG. 4 is a flowchart of an example of a method of supplying liquid by the liquid discharge device according to the present embodiment.

When performing the initial liquid filling, ink in the ink cartridge 15 is supplied to the liquid discharge head 14 through the second liquid flow passage 22 (step S1 in FIG. 4). In other words, the controller 500 first causes the driver of the first liquid supply pump 51 to supply ink in the ink cartridge 15 to the liquid discharge head 14 through the second liquid flow passage 22. Then, in order to discharge air or air bubbles in the liquid circulation passage 23, the ink is drained from the ink supply pressure adjustment tank 32 to the waste liquid tank 34 through the waste liquid flow passage 24 (step S2 in FIG. 4). In other words, the controller 500 causes the driver of the liquid discharge pump 57 to drain the ink from the ink supply pressure adjustment tank 32 to the waste liquid tank 34 through the waste liquid flow passage 24. After the ink is continuously drained from the ink supply pressure adjustment tank 32 to the waste liquid tank 34 for a predetermined time, the draining of the ink is stopped, in other words, the controller 500 causes the driver of the liquid discharge pump 57 to stop discharging the ink. Then, the controller 500 causes the driver of the sixth liquid supply pump 56 disposed on the second liquid flow passage 22 and the third liquid supply pump 53 disposed on the first liquid flow passage 21 to supply the ink with pressure into the liquid discharge head 14 to apply the ink to the partition wall of the liquid discharge head 14 (step S3 in FIG. 4). Then, the ink supplied into the liquid discharge head 14 with pressure brings the liquid (ink) previously filled in the liquid discharge head 14 to be drained to the waste liquid tank 34 and, at the same time, the ink supply through the second liquid flow passage 22 is temporarily stopped (step S4 in FIG. 4). In other words, the controller 500 causes the ink to be supplied into the liquid discharge head 14 to discharge the liquid (ink) previously filled in the liquid discharge head 14 and stops the ink supply through the second liquid flow passage 22. With the above-described operations, the liquid filled in the liquid discharge head 14 is replaced with the newly supplied ink.

Thereafter, the ink is supplied through the second liquid flow passage 22 again (step S5 in FIG. 4). Then, the controller 500 determines whether air bubbles remain in the liquid discharge head 14 (step S6 in FIG. 4). When air bubbles do not remain in the liquid discharge head 14 (YES in step S6 in FIG. 4), the operations of the flowchart of FIG. 4 ends. On the other hand, when air bubbles remain in the liquid discharge head 14 (NO in step S6 in FIG. 4), steps S1 to S5 are repeated until no air bubbles remains in the liquid discharge head 14. Note that, when more ink is supplied to the liquid discharge head 14 after the liquid filled in the liquid discharge head 14 is replaced with the newly supplied ink, excess ink instead of the liquid filled in the liquid discharge head 14 is drained to the waste liquid tank 34. An air bubble detector is provided to detect whether air bubbles are in the liquid discharge head 14. The air bubble detector may be a known detector, for example, an ultrasonic or laser detector capable of detecting air bubbles based on the signal receiving state between a transmitter and a receiver.

As described above, the liquid discharge device 20 according to the present embodiment includes the second liquid flow passage 22. According to this configuration, when performing the initial liquid filling to supply and fill ink in the liquid discharge head 14, the liquid discharge device 20 according to the present embodiment is capable of supplying the ink to the liquid discharge head 14 without passing through the buffer tank 31 that is a second liquid container different from the ink cartridge 15 (first liquid container), the ink supply pressure adjustment tank 32, and the ink collection pressure adjustment tank 33. According to this configuration, the time to supply liquid to the liquid discharge head 14 is shortened, and therefore the waiting time until the printing operation is ready is reduced. Accordingly, particularly in the configuration including a plurality of nozzles and the ink collection pressure adjustment tank 33, in other words, in the configuration in which the time to fill liquid into the liquid discharge head 14 takes relatively long, a significant effect is achieved due to a reduction of time to fill the liquid into the liquid discharge head 14.

Further, the second liquid flow passage 22 is shorter than the first liquid flow passage 21, and the liquid discharge device 20 according to the present embodiment is capable of supplying the liquid to the liquid discharge head 14 for a shorter time. Accordingly, the time to fill the liquid is further reduced, and therefore the printing operation is started at the earlier stage. Note that the lengths of the liquid flow passages to be compared may be the length of the first liquid flow passage 21 from the ink cartridge 15 to the liquid discharge head 14 and the length of the second liquid flow passage 22 from the ink cartridge 15 to the liquid discharge head 14 or may be the length of the first liquid flow passage 21 from the branching point X to the meeting point Y and the length of the second liquid flow passage 22 from the branching point X to the meeting point Y.

In the above-described example, the operation to supply ink to the liquid discharge head 14 through the second liquid flow passage 22 (step S1 in FIG. 4) and the operation to drain ink from the ink supply pressure adjustment tank 32 to the waste liquid tank 34 through the waste liquid flow passage 24 (step S2 in FIG. 4) are performed at different timings. However, these operations may be performed at the same timing. In this case, the time to supply ink to the liquid discharge head 14 is further reduced.

In the above-described example, after the initial liquid filling is performed, the controller 500 determines, based on the result of a detector, whether the amount of liquid in the ink supply pressure adjustment tank 32 is equal to or greater than the predetermined liquid amount and continues circulation of the liquid in the liquid circulation passage 23 to adjust the pressure in the ink supply pressure adjustment tank 32. Thereafter, when the pressure in the ink supply pressure adjustment tank 32 is brought to an appropriate state, the liquid is sufficiently supplied from the ink supply pressure adjustment tank 32 to the liquid discharge head 14. Further, the liquid discharge device 20 according to the present embodiment includes the waste liquid flow passage 24 through which the liquid is directly drained from the ink supply pressure adjustment tank 32 to the waste liquid tank 34. According to this configuration, the liquid is discharged without passing through the liquid discharge head 14 so as to adjust the pressure in the ink supply pressure adjustment tank 32. Further, even though the waste liquid flow passage 24 is directly connected to the ink supply pressure adjustment tank 32 in the above-described example, the configuration is not limited thereto. For example, the waste liquid flow passage 24 may be connected to the liquid flow passage 43 that connects the ink supply pressure adjustment tank 32 and the liquid discharge head 14. That is, the connection of the waste liquid flow passage 24 is not limited as long as the waste liquid flow passage 24 is connected to a part of the first liquid flow passage 21.

In the present embodiment, in a case in which the liquid is consumed, for example, by performing the printing operation after the initial liquid filling is performed to the liquid discharge head 14, liquid from the ink supply pressure adjustment tank 32 through the first liquid flow passage 21 is replenished into the liquid discharge head 14. However, the replenishment of liquid is not limited thereto. For example, the regular liquid after the initial liquid filling is replenished through the second liquid flow passage 22. In this case, the liquid through the first liquid flow passage 21 and the liquid through the second liquid flow passage 22 may be supplied at the same time or may be switched and supplied at the different timings. As described above, the liquid discharge device 20 according to the present embodiment supplies the liquid through the second liquid flow passage 22 when replenishing the regular liquid after the initial liquid filling. This configuration is effective when the liquid is not smoothly supplied from the ink supply pressure adjustment tank 32 to the liquid discharge head 14.

Further, as the amount of liquid in the ink cartridge 15 decreases, it may take a longer time to stably supply liquid from the ink supply pressure adjustment tank 32 to the liquid discharge head 14. In this case, it is preferable to supply liquid through the second liquid flow passage 22 as described in the flowchart of FIG. 5.

Figure 5:
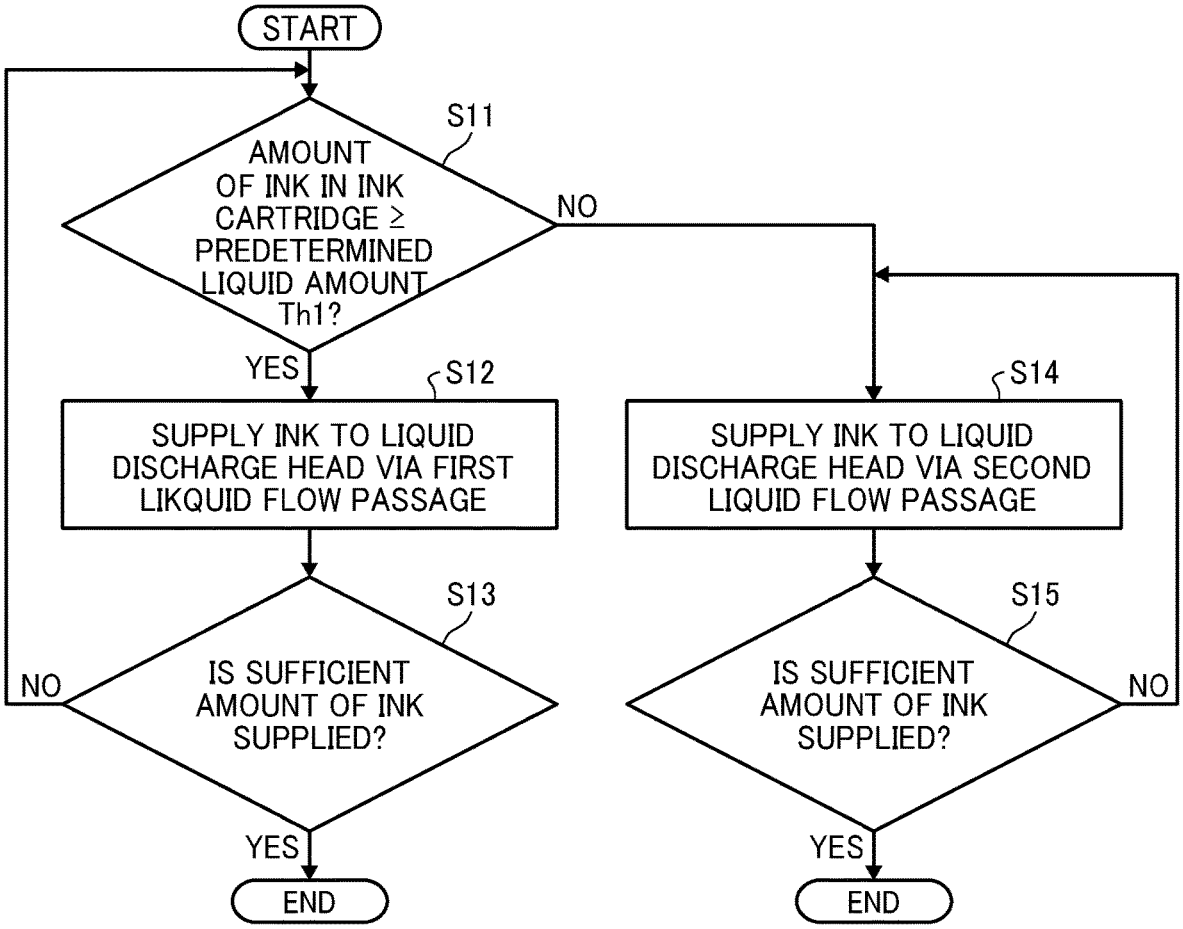
FIG. 5 is a flowchart of another example of the method of supplying liquid by the liquid discharge device according to the present embodiment.

FIG. 5 is a flowchart of another example of the method of supplying liquid by the liquid discharge device according to the present embodiment.

To be more specific, the controller 500 first determines whether the amount of ink contained in the ink cartridge 15 is equal to or greater than a predetermined liquid amount Th1 that is previously set to the ink cartridge 15 (step S11 in FIG. 5). When the amount of ink is equal to or greater than the predetermined liquid amount Th1 (YES in step S11 in FIG. 5), the liquid is supplied to the liquid discharge head 14 through the first liquid flow passage 21 (step S12 in FIG. 5). Then, the controller 500 determines whether the ink is supplied to a sufficient amount to the liquid discharge head 14 (step S13 in FIG. 5). When the ink is supplied to the sufficient amount to the liquid discharge head 14 (YES in step S13 in FIG. 5), the operations in the flowchart of FIG. 5 end. On the other hand, when the ink is not supplied to the sufficient amount to the liquid discharge head 14 (NO in step S13 in FIG. 5), steps S11 to S13 are repeated until the ink is supplied to the sufficient amount to the liquid discharge head 14 through the first liquid flow passage 21.

On the other hand, in a state in which the ink has not yet fully supplied to the liquid discharge head 14 (NO in step S13 in FIG. 5), when the amount of ink in the ink cartridge 15 is smaller than the predetermined liquid amount Th1 (NO in step S11 in FIG. 5), it takes a longer time to supply the liquid from the ink supply pressure adjustment tank 32 to the liquid discharge head 14. Therefore, in that case, the liquid flow passage is changed from the first liquid flow passage 21 to the second liquid flow passage 22 so that the ink is supplied to the liquid discharge head 14 through the second liquid flow passage 22 (step S14 in FIG. 5). Then, the controller 500 determines whether the ink is supplied to a sufficient amount to the liquid discharge head 14 (step S15 in FIG. 5). When the ink is supplied to the sufficient amount to the liquid discharge head 14 (YES in step S15 in FIG. 5), the operations in the flowchart of FIG. 5 end. On the other hand, when the ink is not supplied to the sufficient amount to the liquid discharge head 14 (NO in step S15 in FIG. 5), steps S14 and S15 are repeated until the ink is supplied to the sufficient amount to the liquid discharge head 14.

As described above, when the amount of liquid in the ink cartridge 15 decreases and the time to stably supply the liquid from the ink supply pressure adjustment tank 32 takes relatively long, the liquid is supplied through the second liquid flow passage 22. By so doing, the liquid is supplied to the liquid discharge head 14 in a relatively short time.

Further, as the amount of liquid in the ink supply pressure adjustment tank 32 decreases, the time to adjust the pressure in the ink supply pressure adjustment tank 32 takes relatively long. Therefore, it may take a longer time to supply the liquid from the ink supply pressure adjustment tank 32 to the liquid discharge head 14. Accordingly, also in this case, it is preferable to supply liquid through the second liquid flow passage 22 as illustrated in the flowchart of FIG. 6.

Figure 6:
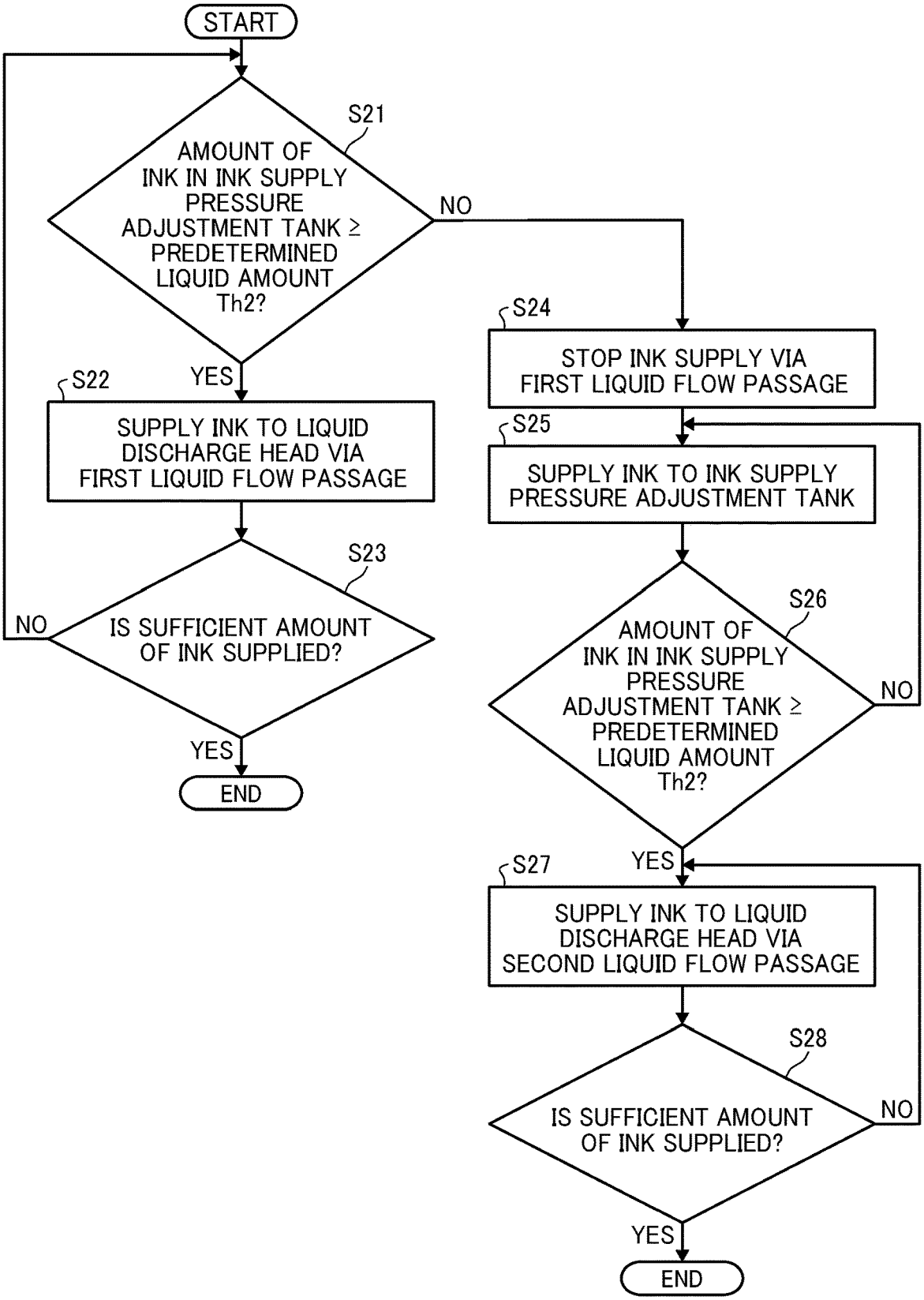
FIG. 6 is a flowchart of yet another example of the method of supplying liquid by the liquid discharge device according to the present embodiment.

FIG. 6 is a flowchart of yet another example of the method of supplying liquid by the liquid discharge device according to the present embodiment.

To be more specific, as described in the flowchart of FIG. 6, the controller 500 determines whether the amount of ink contained in the ink supply pressure adjustment tank 32 is equal to or greater than a predetermined liquid amount Th2 previously set to the ink supply pressure adjustment tank 32 (step S21 in FIG. 6). When the amount of ink is equal to or greater than the predetermined liquid amount Th2 (YES in step S21 in FIG. 6), the liquid is supplied to the liquid discharge head 14 through the first liquid flow passage 21 (step S22 in FIG. 6). Then, the controller 500 determines whether the ink is supplied to a sufficient amount to the liquid discharge head 14 (step S23 in FIG. 6). When the ink is supplied to the sufficient amount to the liquid discharge head 14 (YES in step S23 in FIG. 6), the operations in the flowchart of FIG. 6 end. On the other hand, when the ink is not supplied to the sufficient amount to the liquid discharge head 14 (NO in step S23 in FIG. 6), steps S21 to S23 are repeated until the ink is supplied to the sufficient amount to the liquid discharge head 14.

On the other hand, in a state in which the ink has not yet fully supplied to the liquid discharge head 14 (NO in step S23 in FIG. 6), when the amount of ink in the ink supply pressure adjustment tank 32 is smaller than the predetermined liquid amount Th2 (NO in step S21 in FIG. 6), it takes a longer time to supply the liquid from the ink supply pressure adjustment tank 32 to the liquid discharge head 14. Therefore, in such a case, the controller 500 closes the liquid flow passage 43 (see FIG. 3) that connects the ink supply pressure adjustment tank 32 and the liquid discharge head 14 to stop supplying the liquid (from the ink supply pressure adjustment tank 32) to the liquid discharge head 14 through the first liquid flow passage 21 (step S24 in FIG. 6). Then, in this state, the controller 500 causes the ink to be supplied from the ink cartridge 15 to the ink supply pressure adjustment tank 32 (step S25 in FIG. 6). Thereafter, the controller 500 determines whether the amount of ink contained in the ink supply pressure adjustment tank 32 is equal to or greater than a predetermined liquid amount Th2 (step S26 in FIG. 6). When the amount of ink is smaller than the predetermined liquid amount Th2 (NO in step S26 in FIG. 6), steps S25 and S26 are repeated until the amount of ink becomes equal to or greater than the predetermined liquid amount Th2. On the other hand, when the amount of ink is equal to or greater than the predetermined liquid amount Th2 (YES in step S26 in FIG. 6), the liquid flow passage 43 (the first liquid flow passage 21) is opened to supply the ink to the liquid discharge head 14 through the second liquid flow passage 22 (step S27 in FIG. 6). Then, the controller 500 determines whether the ink is supplied to a sufficient amount to the liquid discharge head 14 (step S28 in FIG. 6). When the ink is supplied to the sufficient amount to the liquid discharge head 14 (YES in step S28 in FIG. 6), the operations in the flowchart of FIG. 6 end. On the other hand, when the ink is not supplied to the sufficient amount to the liquid discharge head 14 (NO in step S28 in FIG. 6), steps S27 and S28 are repeated until the ink is supplied to the sufficient amount to the liquid discharge head 14.

As described above, when the amount of liquid in the ink supply pressure adjustment tank 32 decreases and the time to stably supply the liquid from the ink supply pressure adjustment tank 32 takes relatively long, the liquid is supplied through the second liquid flow passage 22. By so doing, the liquid is supplied to the liquid discharge head 14 in a relatively short time.

Figure 7:
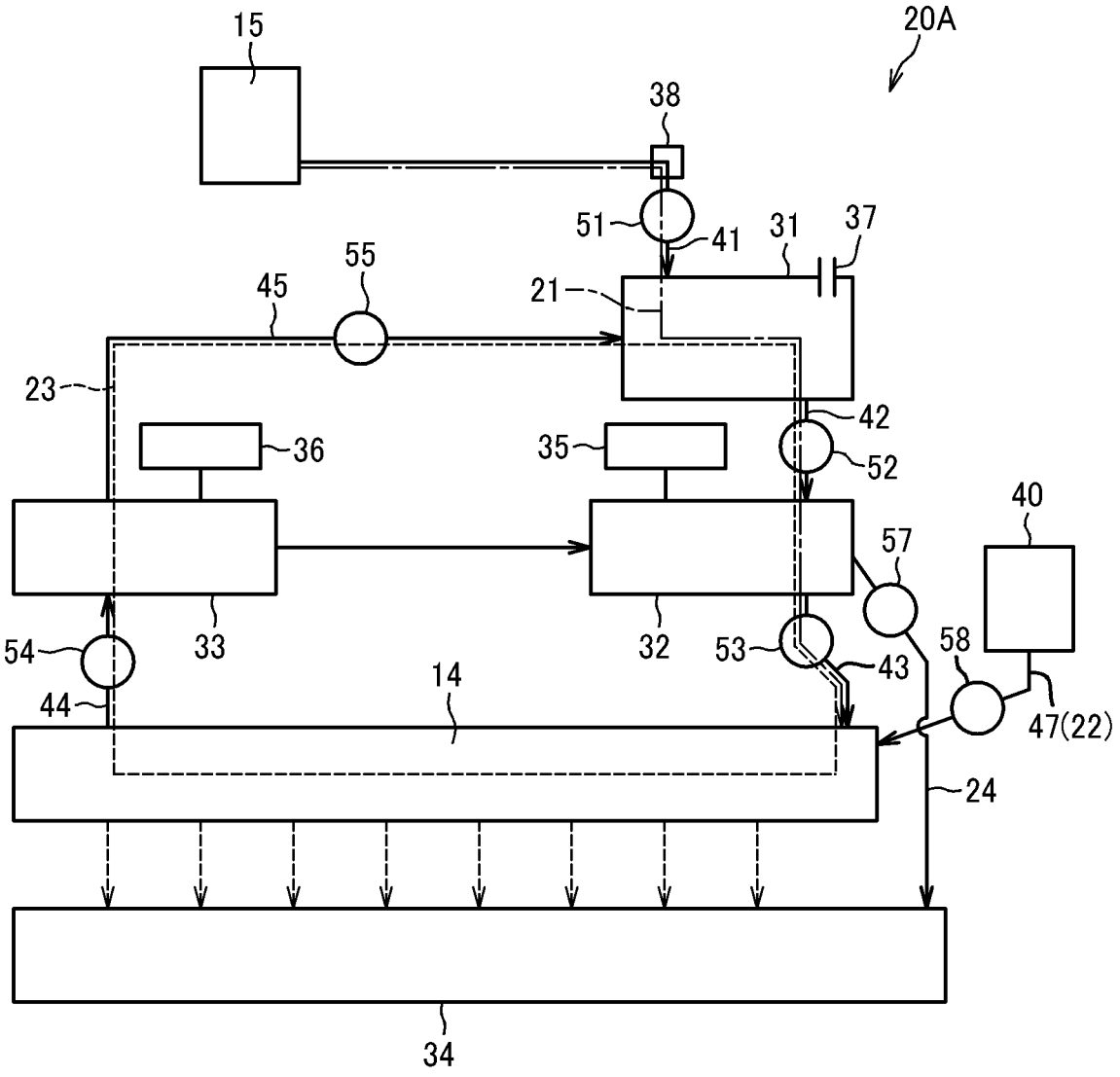
FIG. 7 is a schematic view illustrating a liquid discharge device according to another embodiment of the present disclosure.

Now, a description is given of the configuration of a liquid discharge device according to another embodiment of the present disclosure, with reference to FIG. 7.

FIG. 7 is a schematic view illustrating a liquid discharge device 20A according to another embodiment of the present disclosure.

The liquid discharge device 20A illustrated in FIG. 7 is basically identical to the liquid discharge device 20 illustrated in FIG. 3. Different from the liquid discharge device 20 illustrated in FIG. 3, the liquid discharge device 20A illustrated in FIG. 7 further includes an ink cartridge 40 detachably attached to the liquid discharge head 14. The ink cartridge 40 is dedicated to the initial liquid filling. The ink cartridge 40 dedicated to the initial liquid filling is connected to the liquid discharge head 14 through a liquid flow passage 47 (the second liquid flow passage 22) that is different from the first liquid flow passage 21. Therefore, in the configuration of the present embodiment, the second liquid flow passage 22 that branches off from the first liquid flow passage 21 illustrated in FIG. 3 is omitted. In addition, the liquid discharge device 20A according to the present embodiment further includes a liquid supply pump 58 on the liquid flow passage 47 that connects the ink cartridge 40 dedicated to the initial liquid filling and the liquid discharge head 14. The liquid supply pump 58 functions as a liquid supplier to supply the liquid from the ink cartridge 40 dedicated to the initial liquid filling to the liquid discharge head 14. Except for the above-described configuration, the liquid discharge device 20A illustrated in FIG. 7 is basically identical to the liquid discharge device 20 illustrated in FIG. 3.

In this case, the liquid discharge device 20A according to the present embodiment is capable of supplying the liquid directly from the ink cartridge 40 dedicated to the initial liquid filling to the liquid discharge head 14 and supplying the liquid without passing through the first liquid flow passage 21 (the buffer tank 31, the ink supply pressure adjustment tank 32, and the ink collection pressure adjustment tank 33). Therefore, also in the present embodiment, the liquid discharge device 20A supplies the liquid to the liquid discharge head 14 in a relatively short time. Furthermore, the ink cartridge 40 dedicated to the initial liquid filling is disposed near the liquid discharge head 14, thereby reducing the length of the liquid flow passage 47 (the second liquid flow passage 22) to supply the liquid from the ink cartridge 40 dedicated to the initial liquid filling to the liquid discharge head 14. Further, when the initial liquid filling is completed and the ink cartridge 40 dedicated to the initial liquid filling is empty, the ink cartridge 40 is not required. Therefore, the controller 500 may display a message on a display panel to notify a user to encourage disposal (removal) of the ink cartridge 40 with no ink (liquid) left inside (empty).

Figure 8:
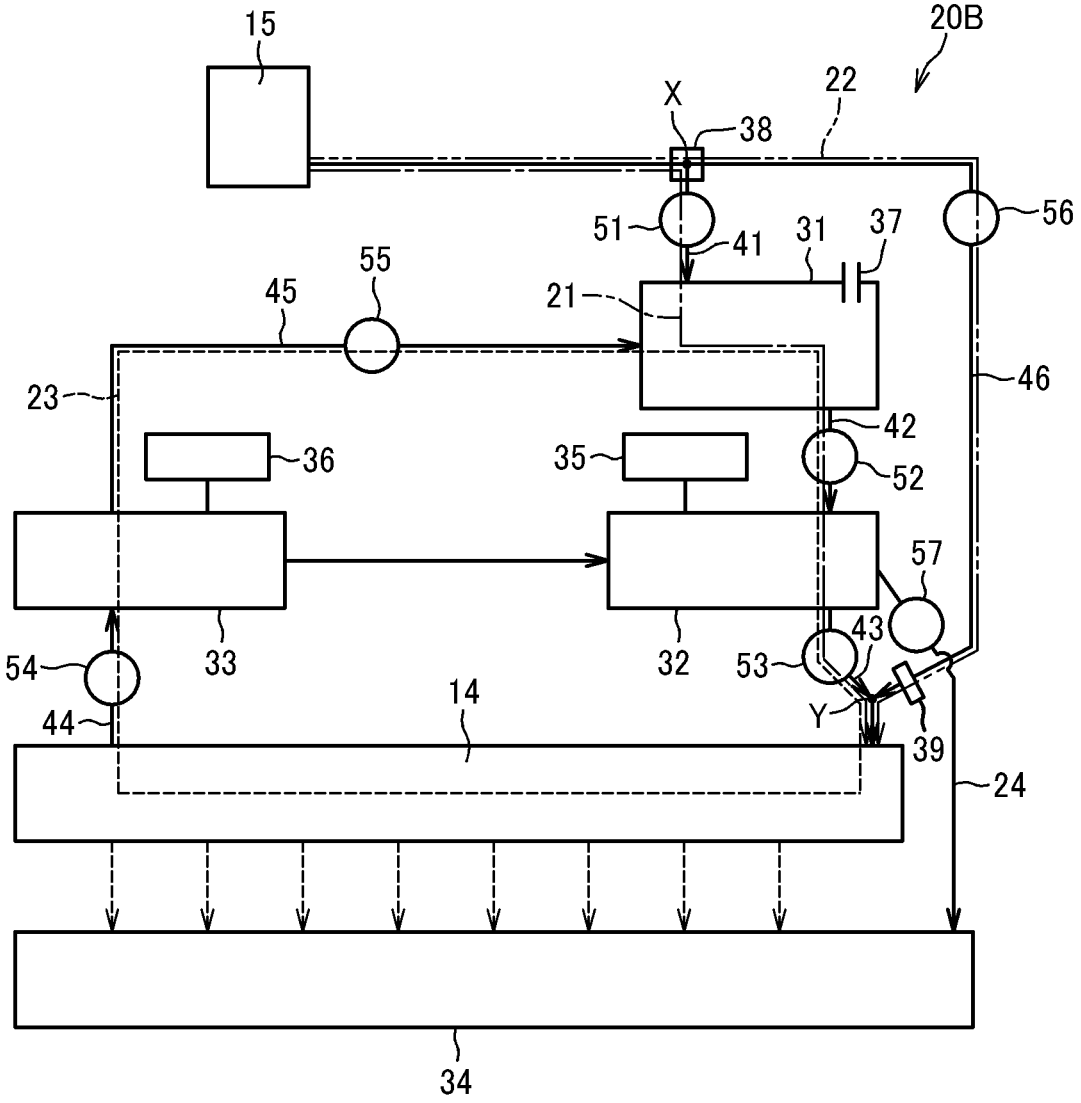
FIG. 8 is a schematic view illustrating a liquid discharge device according to yet another embodiment of the present disclosure.

Now, a description is given of the configuration of a liquid discharge device according to yet another embodiment of the present disclosure, with reference to FIG. 8.

FIG. 8 is a schematic view illustrating a liquid discharge device 20B according to yet another embodiment of the present disclosure.

The liquid discharge device 20B illustrated in FIG. 8 is basically identical to the liquid discharge device 20 illustrated in FIG. 3. Different from the liquid discharge device 20 illustrated in FIG. 3, the liquid discharge device 20B illustrated in FIG. 8 further includes a backflow prevention valve 39 between the branching point X of the second liquid flow passage 22 and the meeting point Y of the second liquid flow passage 22. The backflow prevention valve 39 functions as a backflow preventer to prevent backflow of the liquid in an opposite direction opposite the liquid supply direction to the liquid discharge head 14. Except for the above-described configuration, the liquid discharge device 20B illustrated in FIG. 8 is basically identical to the liquid discharge device 20 illustrated in FIG. 3.

In this case, the backflow prevention valve 39 is provided on the second liquid flow passage 22. Therefore, even if the liquid is supplied from the ink supply pressure adjustment tank 32 to the liquid discharge head 14 after the liquid is supplied to the liquid discharge head 14 through the second liquid flow passage 22, the liquid does not backflow to the upstream side of the second liquid flow passage 22 in the liquid supply direction. Accordingly, the liquid is supplied to the liquid discharge head 14 reliably. Further, the liquid discharge device 20B prevents backflow of the liquid to the second liquid flow passage 22. Therefore, when the liquid in the ink cartridge 15 is used up, in other words, the ink cartridge 15 is empty, the sixth liquid supply pump 56 provided on the second liquid flow passage 22 supplies the liquid, so that the second liquid flow passage 22 remains empty. That is, even when the liquid is supplied from the ink supply pressure adjustment tank 32 to the liquid discharge head 14 when the second liquid flow passage 22 is empty, the liquid does not backflow toward the upstream side of the second liquid flow passage 22. Accordingly, the liquid discharge device 20B according to the present embodiment empties the second liquid flow passage 22 to effectively use the liquid. Further, the liquid discharge device 20B avoids a state in which the liquid is left for a long period of time while the liquid remains in the second liquid flow passage 22. Therefore, the liquid discharge device 20B prevents clogging of the liquid in the second liquid flow passage 22, and therefore prevents supplying deteriorated old liquid from the second liquid flow passage 22 to the liquid discharge head 14.

The above-described embodiments are illustrative and do not limit this disclosure. It is therefore to be understood that within the scope of the appended claims, numerous additional modifications and variations are possible to this disclosure otherwise than as specifically described herein. For example, in the configurations according to the above-described embodiments, in a case in which the buffer tank 31 and the ink collection pressure adjustment tank 33 are not required, the buffer tank 31 and the ink collection pressure adjustment tank 33 may be omitted or removed.

Further, the liquid discharge devices and the methods of supplying liquid according to the present disclosure may be applicable to the image forming apparatus 100 having the configuration illustrated in FIG. 1 but the configuration is not limited thereto. For example, the present disclosure may be applied to an image forming apparatus having the configuration as illustrated in FIG. 9 or an image forming apparatus having the configuration as illustrated in FIG. 10.

Figure 9:
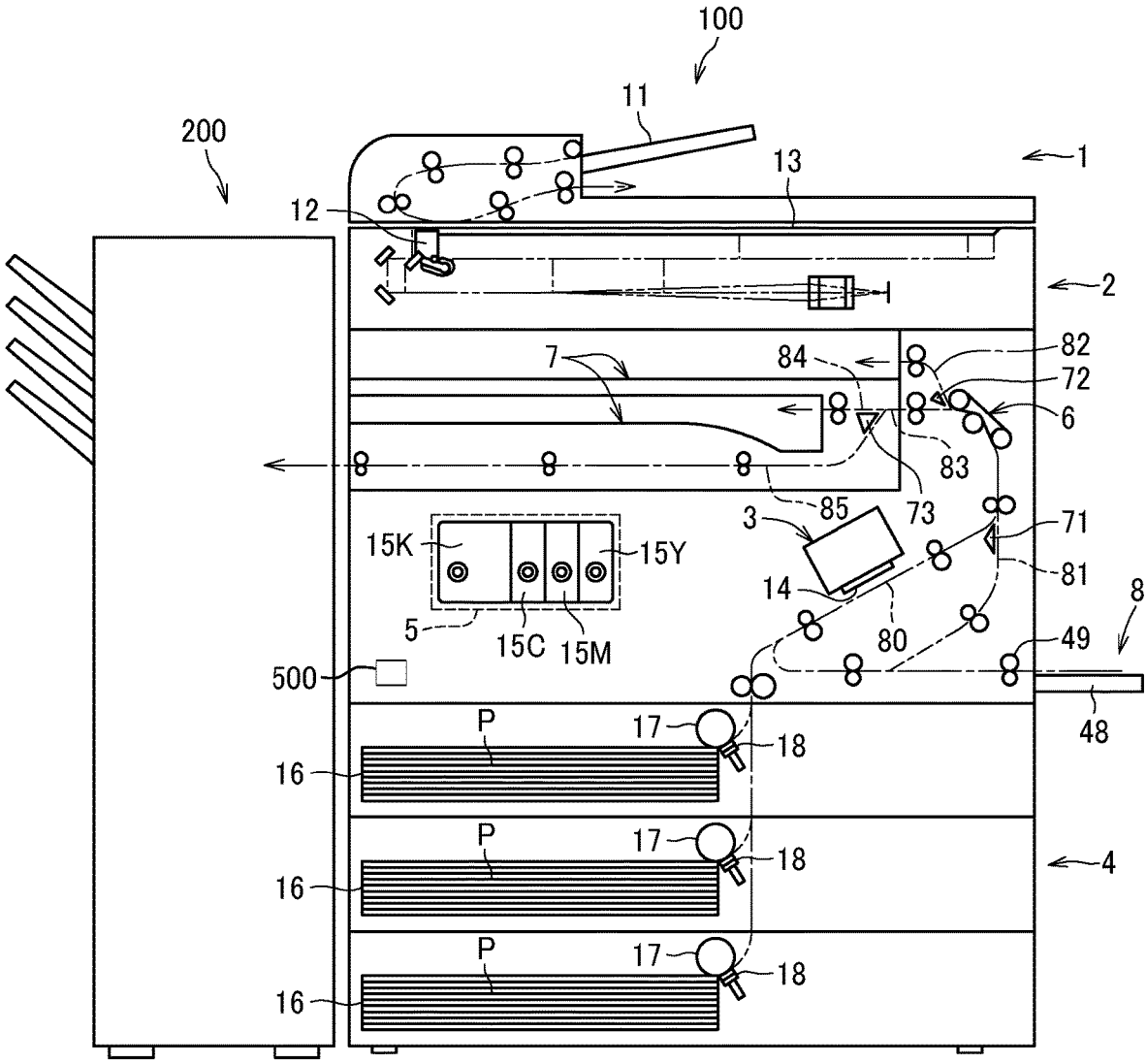
FIG. 9 is a diagram illustrating the configuration of another image forming apparatus.
Figure 10:
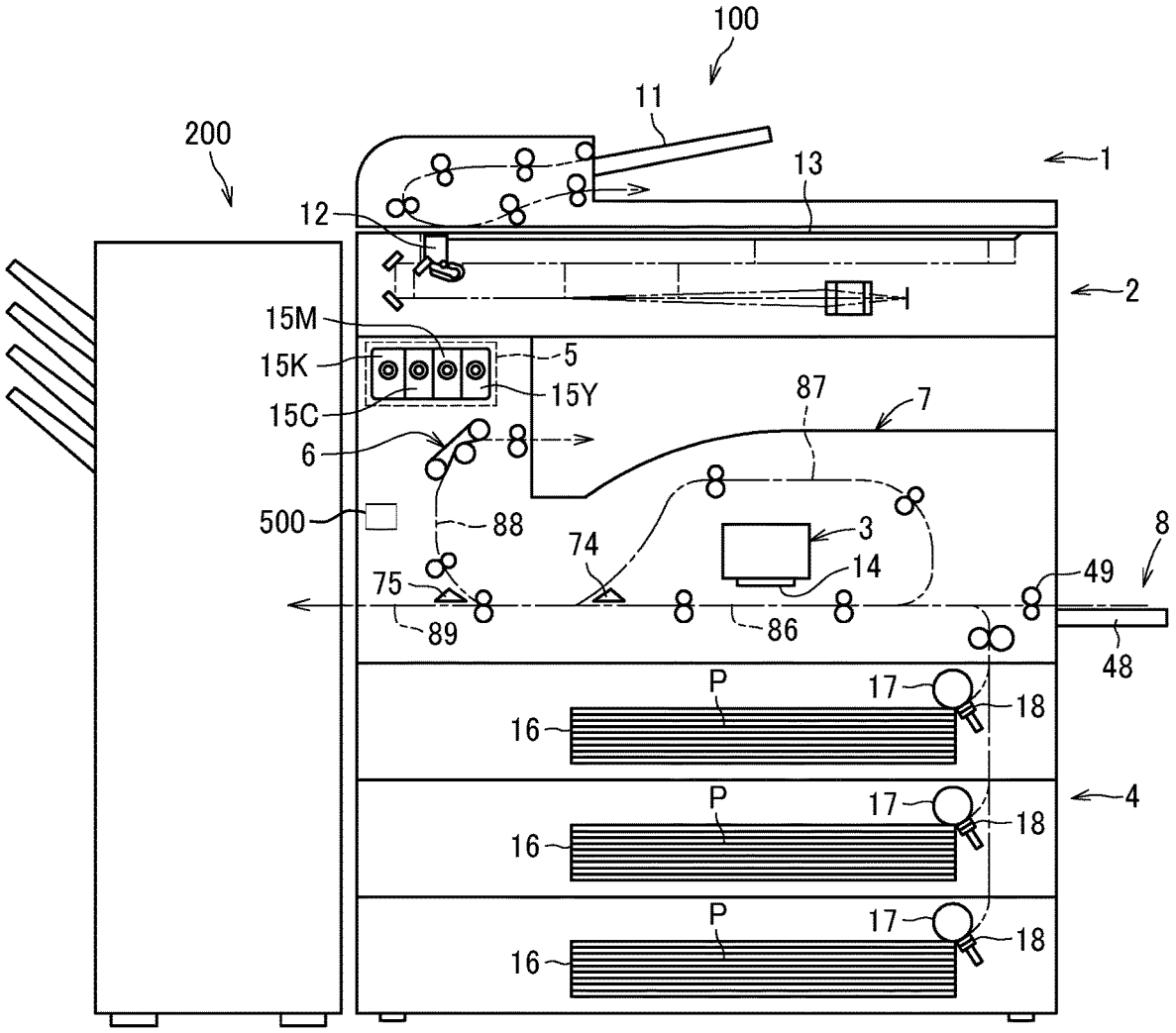
FIG. 10 is a diagram illustrating the configuration of yet another image forming apparatus.

Next, a description is given of the configuration of the image forming apparatus 100 with reference to FIGS. 9 and 10.

FIG. 9 is a diagram illustrating the configuration of another image forming apparatus 100.

FIG. 10 is a diagram illustrating the configuration of yet another image forming apparatus 100.

Note that the following description is given of the configuration of the image forming apparatus 100 illustrated in FIGS. 9 and 10 different from the configuration of the above-described image forming apparatus 100. That is, the description of the configuration of the image forming apparatus 100 of FIGS. 9 and 10 that is same as the configuration of the image forming apparatus 100 according to the above-described embodiment, for example, the image forming apparatus 100 illustrated in FIG. 1, may be omitted.

Similar to the image forming apparatus 100 according to the above-described embodiments, the image forming apparatus 100 illustrated in FIG. 9 includes the original document conveying device 1, the image reading device 2, the image forming device 3, the sheet feeding device 4, the cartridge container 5, the drying device (heating device) 6, and the sheet ejection portion 7. Different from the image forming apparatus 100 according to the above-described embodiments, the image forming apparatus 100 illustrated in FIG. 9 further includes a bypass sheet feeding device 8. Different from the image forming device 3 in FIG. 1, the image forming device 3 in FIG. 9 is disposed facing a sheet conveyance passage 80 in which the sheet P is conveyed in a direction obliquely to the horizontal direction.

The bypass sheet feeding device 8 includes a bypass sheet feed tray 48 and a bypass sheet feed roller 49. The bypass sheet feed tray 48 functions as a sheet loader to load the sheet P. The bypass sheet feed roller 49 functions as a sheet feeder to feed the sheet P from the bypass sheet feed tray 48. The bypass sheet feed tray 48 is attached to open and close with respect to the housing of the image forming apparatus 100. In other words, the bypass sheet feed tray 48 is rotatably attached to the housing of the image forming apparatus 100. When the bypass sheet feed tray 48 is open (i.e., the state in FIG. 9), the sheet P or the bundle of sheets including the sheet P is loaded on the bypass sheet feed tray 48 to feed the sheet P to the housing of the image forming apparatus 100.

In the image forming apparatus 100 illustrated in FIG. 9, as a print job start instruction is issued, the sheet P is supplied from the sheet feeding device 4 or from the bypass sheet feeding device 8 and is conveyed to the image forming device 3. Then, when the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having the image on one side or both sides is conveyed to the drying device 6 in which the ink on the sheet P is dried. Note that it is preferable that, when drying the ink on the front face of the sheet P and then forming an image on the back face of the sheet P, the drying device 6 dries the ink on the front face of the sheet P first, and then, the sheet P is conveyed in a sheet conveyance passage that detours the drying device 6. Then, it is also preferable that the direction of conveyance of the sheet P is switched back (changed) to the upstream side from the drying device 6 in the sheet conveyance direction, and the sheet P is guided to the image forming device 3 again through the sheet reverse passage 81. After the sheet P has passed the drying device 6, a second passage changer 72 guides the sheet P selectively to a sheet conveyance passage 82 that runs toward the upper sheet ejection portion 7 or to a sheet conveyance passage 83 that runs to the lower sheet ejection portion 7. In a case in which the sheet P is guided to the sheet conveyance passage 82 toward the upper sheet ejection portion 7, the sheet P is ejected to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the post-processing apparatus 200.

Then, when the sheet P is guided to the sheet conveyance passage 84 toward the lower sheet ejection portion 7, the sheet P is ejected to the lower sheet ejection portion 7. On the other hand, in a case in which the sheet P is guided to the sheet conveyance passage 85 toward the post-processing apparatus 200, the sheet P is conveyed to the post-processing apparatus 200, so that the post-processing operation is performed to the sheet P.

Similar to the image forming apparatus 100 illustrated in FIG. 9, the image forming apparatus 100 illustrated in FIG. 10 includes the original document conveying device 1, the image reading device 2, the image forming device 3, the sheet feeding device 4, the cartridge container 5, the drying device (heating device) 6, the sheet ejection portion 7, and the bypass sheet feeding device 8. Note that, in this case, similar to the image forming device 3 included in the image forming apparatus 100 in FIG. 1, the image forming device 3 included in the image forming apparatus 100 illustrated in FIG. 10 is disposed facing a sheet conveyance passage 86 in which the sheet P is conveyed in the horizontal direction.

In the image forming apparatus 100 illustrated in FIG. 10, as a print job start instruction is issued, the sheet P is supplied from the sheet feeding device 4 or from the bypass sheet feeding device 8 and is conveyed to the image forming device 3. Then, when the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

After an image is formed on one side or both sides of the sheet P, a second passage changer 75 guides the sheet P selectively to a sheet conveyance passage 88 that runs toward the drying device 6 or to a sheet conveyance passage 89 that runs to the post-processing apparatus 200. When the sheet P is guided to the sheet conveyance passage 88 toward the drying device 6, the drying device 6 dries the ink on the sheet P. Note that, when drying the ink on the front face of the sheet P and then forming an image on the back face of the sheet P, it is preferable that, after the drying device 6 has dried the ink on the front face of the sheet P first, the sheet P is conveyed in a sheet conveyance passage that detours the drying device 6. Then, it is also preferable that the direction of conveyance of the sheet P is switched back (changed) to the upstream side from the sheet conveyance passage 88 (upstream sides from the drying device 6) in the sheet conveyance direction, and the sheet P is guided to the image forming device 3 again through the sheet reverse passage 87. Consequently, the sheet P that has passed the drying device 6 is ejected to the sheet ejection portion 7. On the other hand, in a case in which the sheet P is guided to the sheet conveyance passage 89 toward the post-processing apparatus 200, the sheet P is conveyed to the post-processing apparatus 200, so that the post-processing operation is performed to the sheet P.

Similar to the above-described image forming apparatus 100, each of the image forming apparatus 100 illustrated in FIG. 9 and the image forming apparatus 100 illustrated in FIG. 10 includes the second liquid flow passage 22 that is capable of conveying liquid to the liquid discharge head 14 without causing the liquid to pass the buffer tank 31, the ink supply pressure adjustment tank 32, and the ink collection pressure adjustment tank 33. According to this configuration, the image forming apparatus 100 illustrated in FIG. 9 and the image forming apparatus 100 illustrated in FIG. 10 supply the liquid to the liquid discharge head 14 in a shorter time.

In the present disclosure, the term "liquid" that is used as liquid discharged from a liquid discharge head includes any liquid having a viscosity or a surface tension that is discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Further, examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge device" used herein includes a device to discharge liquid by driving the liquid discharge head. The liquid discharge device may be, for example, a device capable of discharging liquid to a material to which liquid is applied and a device to discharge liquid toward gas or into liquid.

The "liquid discharge device" may include at least one of devices for feeding, conveying, and ejecting a material to which liquid is applied. The liquid discharge apparatus may further include at least one of a pre-processing device and a post-processing device.

The "liquid discharge device" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge device" is not limited to a device to discharge liquid to visualize meaningful images, such as letters or figures. For example, the liquid discharge apparatus may be an apparatus to form arbitrarily images, such as arbitrarily patterns, or fabricate three-dimensional images.

The above-described term "material onto which liquid is applied" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid is applied" include recording media or medium such as a paper sheet, a recording paper, and a recording sheet of paper, film, and cloth, electronic components such as an electronic substrate and a piezoelectric element, and media or medium such as a powder layer, an organ model, and a testing cell. The "material onto which liquid is applied" includes any material on which liquid adheres unless particularly limited.

Further, the above-mentioned "material onto which liquid is applied" may be any material as long as liquid is temporarily adhered such as paper, thread, fiber, cloth, leather, metal, plastic, glass, wood, ceramics, or the like.

The "liquid discharge device" may be a device to relatively move the liquid discharge head and a material on which liquid is applied. However, the liquid discharge device is not limited to such a device. As an example of the liquid discharge device other than a line-type liquid discharge device that employs a line-type liquid discharge head and discharges liquid without moving the line-type liquid discharge head as described above, the "liquid discharge device" may be a serial-type liquid discharge device that moves the liquid discharge head.

Figure 11:
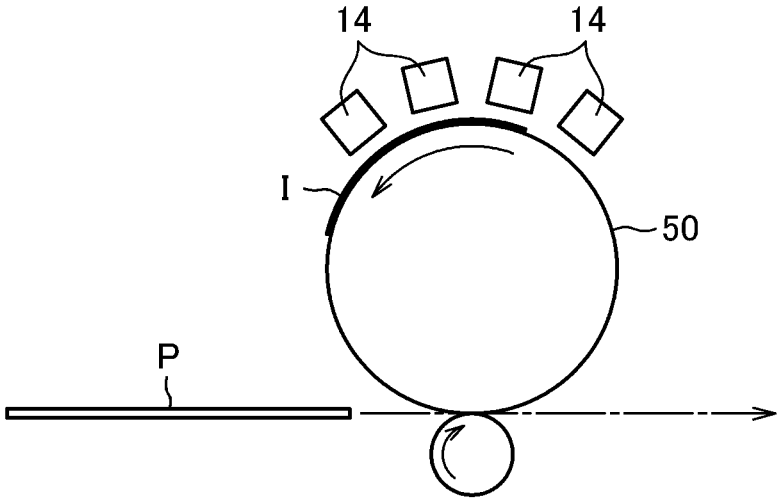
FIG. 11 is a schematic view illustrating another example of the liquid discharge device.

Further, the liquid discharge device is not limited to a device employing the method of directly applying liquid from the nozzle of the liquid discharge head 14 to the sheet P as in the above-described embodiment. For example, FIG. 11 is a diagram illustrating the configuration of a liquid discharge device that discharges liquid to a sheet via the rotary body. As illustrated in FIG. 11, the liquid discharge device may be a device employing a method of indirectly applying liquid by discharging, e.g., the ink I from the liquid discharge head 14 onto the surface of a drum-shaped rotary body 50 and contacting the rotary body 50 with the ink I on the surface of the rotary body 50, to the sheet P. In other words, the liquid discharge head 14 discharges liquid onto the surface of the rotary body 50 and the rotary body 50 contacts the sheet P to apply the liquid on the surface of the rotary body 50 onto the sheet P.

Examples of the "liquid discharge apparatus" further include a treatment liquid coating apparatus to discharge the treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials. Further, there is an injection granulation apparatus for spraying a composition liquid in which raw materials are dispersed in a solution through a nozzle to granulate fine particles of the raw material.

Note that the terms "image formation", "recording", "printing", "image printing", and "fabricating" used herein may be used synonymously with each other.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid discharge device comprising:

a first liquid container to contain liquid;

a liquid discharger to discharge the liquid supplied from the first liquid container in a liquid supply direction;

a second liquid container to contain the liquid supplied from the first liquid container and disposed upstream to the liquid discharger in the liquid supply direction;

a first liquid flow passage through which the liquid is supplied from the first liquid container, the second liquid container, to the liquid discharger in this order; and a second liquid flow passage through which the liquid is supplied from the first liquid container to the liquid discharger without passing through the second liquid container.

2. The liquid discharge device according to claim 1, further comprising a passage switcher to switch between the first liquid flow passage and the second liquid flow passage.

3. The liquid discharge device according to claim 1, further comprising a pressure adjuster downstream from the second liquid container in the liquid supply direction.

4. The liquid discharge device according to claim 1, wherein the second liquid flow passage is shorter than the first liquid flow passage.

5. The liquid discharge device according to claim 1, wherein the liquid is supplied from the first liquid container to the liquid discharger through the second liquid flow passage in a case in which an amount of the liquid contained in the first liquid container is smaller than a predetermined amount.

6. The liquid discharge device according to claim 1, wherein the liquid is not supplied to the liquid discharger through the first liquid flow passage and is supplied from the first liquid container to the second liquid container in a case in which an amount of the liquid contained in the second liquid container is smaller than a predetermined amount of liquid in the second liquid container, and wherein the first liquid flow passage is opened and the liquid is supplied from the first liquid container to the liquid discharger through the second liquid flow passage in a case in which an amount of the liquid contained in the second liquid container is equal to or greater than the predetermined amount of liquid in the second liquid container.

7. The liquid discharge device according to claim 1, further comprising:

a liquid collector to collect the liquid; and a waste liquid flow passage to drain the liquid to the liquid collector from a part of the first liquid flow passage while the liquid is supplied to the liquid discharger through the second liquid flow passage.

8. The liquid discharge device according to claim 7, wherein, after completion of supplying the liquid to the liquid discharger through the second liquid flow passage, the liquid is drained to the liquid collector through the waste liquid flow passage at a same time when the liquid is supplied to the liquid discharger through the second liquid flow passage again.

9. The liquid discharge device according to claim 1, wherein the first liquid flow passage and the second liquid flow passage meet each other at a point upstream from the liquid discharger in the liquid supply direction to communicate with the liquid discharger.

10. The liquid discharge device according to claim 1, further comprising a backflow preventer to prevent backflow of the liquid in an opposite direction opposite the liquid supply direction.

11. An image forming apparatus comprising:

a sheet feeder to feed a sheet; and the liquid discharge device according to claim 1, wherein the liquid discharge device discharges the liquid onto the sheet supplied from the sheet feeding device.

12. A method of supplying liquid to a liquid discharger to discharge liquid, the method comprising selectively executing:

a first liquid supply process to supply the liquid from a first liquid container which contains the liquid, a second liquid container which contains the liquid supplied from the first liquid container, to the liquid discharger in this order; and a second liquid supply process to supply the liquid from the first liquid container to the liquid discharger without passing through the second liquid container, wherein the second liquid container is disposed upstream to the liquid discharger in the liquid supply direction.

* * * * *